US005613925A

United States Patent [19]

Miasserian

[11] Patent Number: 5,613,925

[45] Date of Patent: Mar. 25, 1997

[54] PUNCHING DEVICE

[76] Inventor: Gregory G. Miasserian, 26 Beacon St., Apt. 37E, Burlington, Mass. 01803

[21] Appl. No.: 334,419

[22] Filed: Nov. 4, 1994

[51] Int. Cl.[6] ..... A63B 69/34

[52] U.S. Cl. ..... 482/83; 482/87; 482/86

[58] Field of Search ..... 273/55 R, 26 E; 482/83–90, 148

[56] References Cited

U.S. PATENT DOCUMENTS 2,253,758 8/1941 Bulloch ..... 482/83

4,353,545 10/1982 Anderson ..... 482/83

*Primary Examiner*—Jerome Donnelly

*Attorney, Agent, or Firm*—William J. Daley, Jr.

[57] ABSTRACT

The invention provides a punching device which consists of two component units. One unit has an upstanding panel which is mountable on a floor or a wall and is basically a flat board with six pad devices with three attached horizontally as the top group and three others attached horizontally at a distance below the upper group. Each pad has a spring attached to the back of the pads and to the flatboard. The pads compress and then spring back when struck by a punch. The second unit is a motorized arm which has a boxing glove attached to the end of the motorized arm. The arm device is attached to the motor pipe device which provides any desired speed of rotation of the arm device including a random setting. The arm swings 360° through the top and bottom of groups of pads of component one. The user of the punching device will seek to avoid getting hit by the boxing glove device which is rotating while the user is punching the six pad devices. This makes it an interesting, enjoyable, yet practical punching device which closely simulates actual boxing.

3 Claims, 5 Drawing Sheets

PUNCHING DEVICE

BACKGROUND OF THE INVENTION

1. Field Of The Invention

The present invention relates generally to a punching device and more particularly to a new and improved punching device for a user which has one piece containing six pads attached thereto and a second piece having a motorized arm which has a boxing glove attached thereto.

2. Description Of Prior Art

The following patents are believed to exemplify the present state of the art with respect to punching devices.

U.S. Pat. No. 4,593,900 discloses a boxing robot which is composed of a figure simulating a boxer which is mounted to a post. A first arm is mounted to the post for pivoting in a vertical plane. A second arm is mounted to a vertical rod mounted within the figure. A prime mover causes the rod to rotate and as it does so, the second arm rotates in a horizontal plane. A roller is connected to the rod and periodically contacts the second arm thereby causing the arm to elevate. Gravity causes the second arm to fall when it is not contacted by the roller. The roller is so positioned to the rod that it causes the second arm to elevate when the first arm is behind the figure and allows the second arm to fall when the first arm is in front of the figure.

U.S. Pat. No. 4,401,303 discloses an athletic reflex machine which has a human simulative body pivotally mounted on a pedestal, human-opponent sensing means peering out of a window at the eye position and a respective gimbal-mounted pneumatically powered striker simulating each of the arms and legs; when a user (human target) is sensed within range one or more of the strikers may lash out in the direction in which the target is sensed, regardless of whether the body exactly faces the target; a random interruption is provided to make the response less predictable.

U.S. Pat. No. 4,353,545 discloses an athletic reflex machine. The martial-arts practice apparatus includes an upright panel with a plurality of pneumatically actuable strikers valve-controlled to lash-out toward the user and retract in simulation of weaponless combat; sequence of actuation of the strikers is determinable by a motor driven lobe-roll with adjustable lobes or cams for actuating the striker-control valves, or without this provision, manually by depression of valve actuators in any sequence desired, permitting a colleague of the user to engage in a contest with the user through selective actuation of the strikers; two or more strikers can be actuated to lash out simultaneously.

The foregoing patents as well as the following patents are believed to exemplify the present state of the art with respect to such punching devices:

U.S. Pat. No. 4,765,609
U.S. Pat. No. 4,201,379
U.S. Pat. No. 805,543

While such prior art devices provide improvement in the areas intended, there still exists a great need for a punching device which overcomes the disadvantages of the prior art devices and provides a new and improved unique punching device which includes two basic units.

Accordingly, a principle desirable object of the present invention is to provide a new and improved punching device consisting of two unique components.

Another desirable object of the present invention is to provide six pad devices where three are positioned horizontally as the upper group and three others are positioned horizontally at a distance below the upper group.

Another desirable object of the present invention is to provide a second piece device which is positioned so that an upper foam covered arm has a boxing glove device attached which will rotate around and between the upper and lower groups of pad devices.

These and other desirable objects of the present invention will in part appear hereinafter and will in part become apparent after consideration of the specification with reference to the drawings and the claims.

SUMMARY OF THE INVENTION

The present invention provides a new and improved punching device which consists of a piece of exercise equipment consisting of two component units. One unit has an upstanding panel which is mountable on a floor or a wall and is basically a flat board with six pad devices with three attached horizontally as the top group and three others attached horizontally at a distance below the upper group. Each pad has a spring attached to the back of each pad and to the flatboard. The pads compress and then spring back when struck by a punch.

The second unit is a motorized arm which has a boxing glove attached to the end of the motorized arm. The arm device is attached to the motor pipe device which provides any desired speed of rotation of the arm device including a random setting. The arm swings 360° through the top and bottom groups of pads of component one. The user of the punching device will seek to avoid getting hit by the boxing glove device which is rotating while the user is punching the six pad devices. This makes it an interesting, enjoyable, yet practical punching device which closely simulates actual boxing.

BRIEF DESCRIPTION OF THE DRAWINGS

For a fuller understanding of the nature and desired objects of the present invention, reference should be made to the following detailed description taken in conjunction with the accompanying drawings wherein like reference characters denote corresponding parts throughout several views and wherein.

DETAILED DESCRIPTION OF PREFERRED EMBODIMENT(S)

Figure 1:
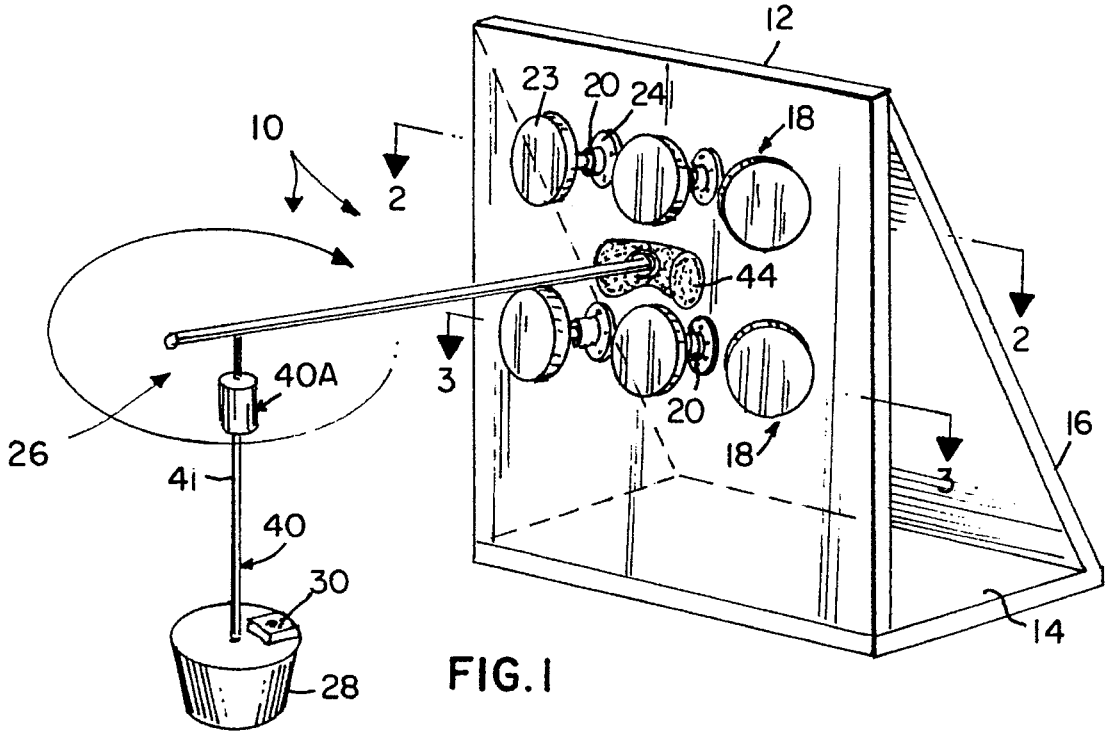
FIG. 1 is a perspective view illustrating one embodiment of a punching device embodying the principles of the present invention and showing the six pad devices where three are positioned horizontally as the upper group and three others are positioned horizontally at a lower position and the motorized arm showing the boxing glove device rotating.
Figure 2:
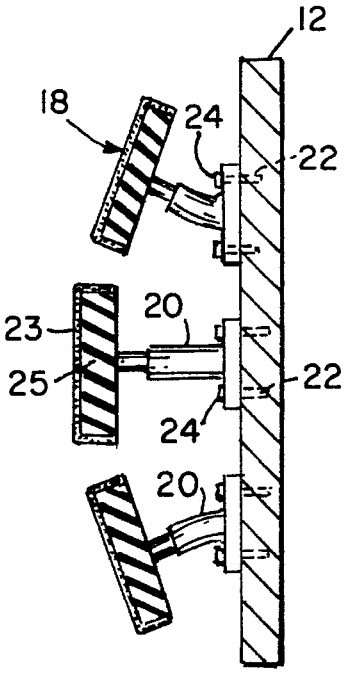
FIG. 2 is a cross-sectional view taken along the line 2—2 of FIG. 1 showing only the upper pad devices.
Figure 3:
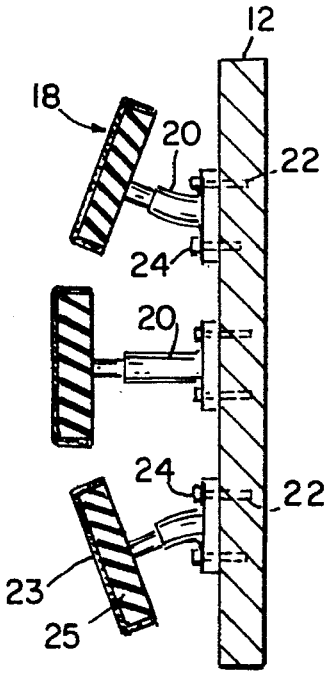
FIG. 3 is a cross-sectional view taken along the line 3—3 of FIG. 1 showing only the lower pad devices.
Figure 4:
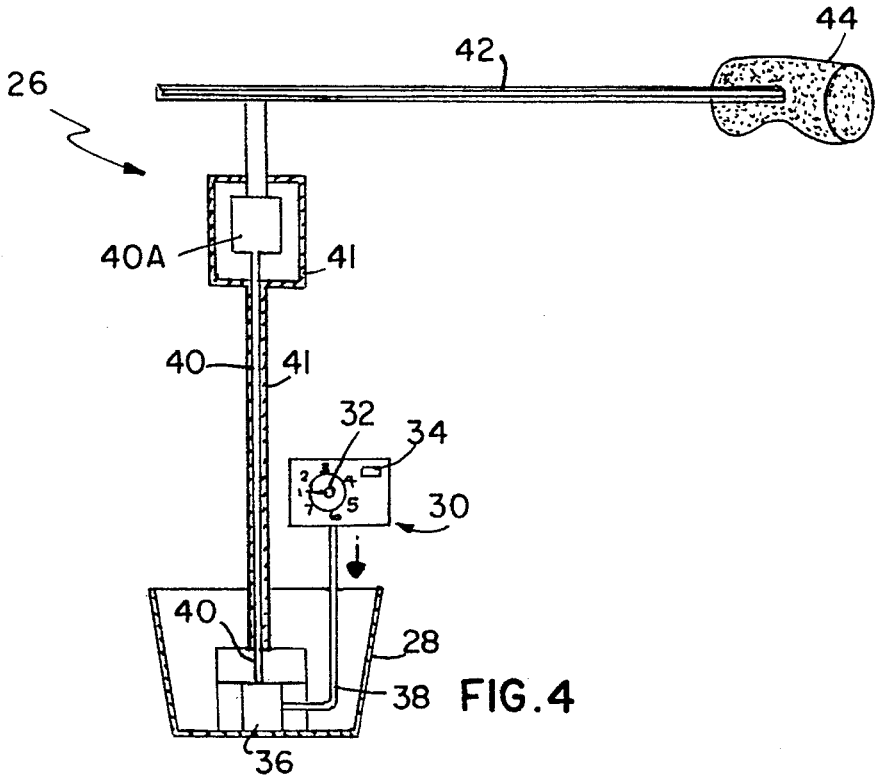
FIG. 4 is an elevational view of the motorized arm device of the invention of FIG. 1.

Referring now to the drawings and more particularly to FIGS. 1–4, there is illustrated an embodiment of the punching device, indicated generally by the reference numeral 10, embodying the principles of the present invention. FIG. 1 shows the invention 10 as having an upstanding flat board 12 held by a bottom base board 14 extending toward the rear of the flat board 12 with diagonal support braces 16 attached to the bottom base board 14 and the upstanding flat board 12. Attached to the front of the upstanding flat board 12 are six round pad devices 18. Each pad device 18 has a spring attaching device 20. The spring devices 20 are attached to the flat board member 12 which is attached by conventional bolt and nut members 22 and 24. The pad devices 18 are preferably formed of an outer leather covering device 23 and an inside rubber pad device.

The motorized arm device 26 is preferably formed of a weighted stand 28 which contains an operating device 30 which contains a speed control device 32 and an on/off switch device 34. The on/off switch 34 contacts a control system device 36 which is contacted by the electrical motorized device 38 which causes the control system 36 to rotate the inside pipe 40 and the upper portion 40A which are covered by the device 41. The upper portion 40A is attached to the arm device 42 and rotates the boxing glove 44 which is attached to the end of the arm device 42 as shown in FIGS. 1, 4, 5, 6 and 7.

Figure 5:
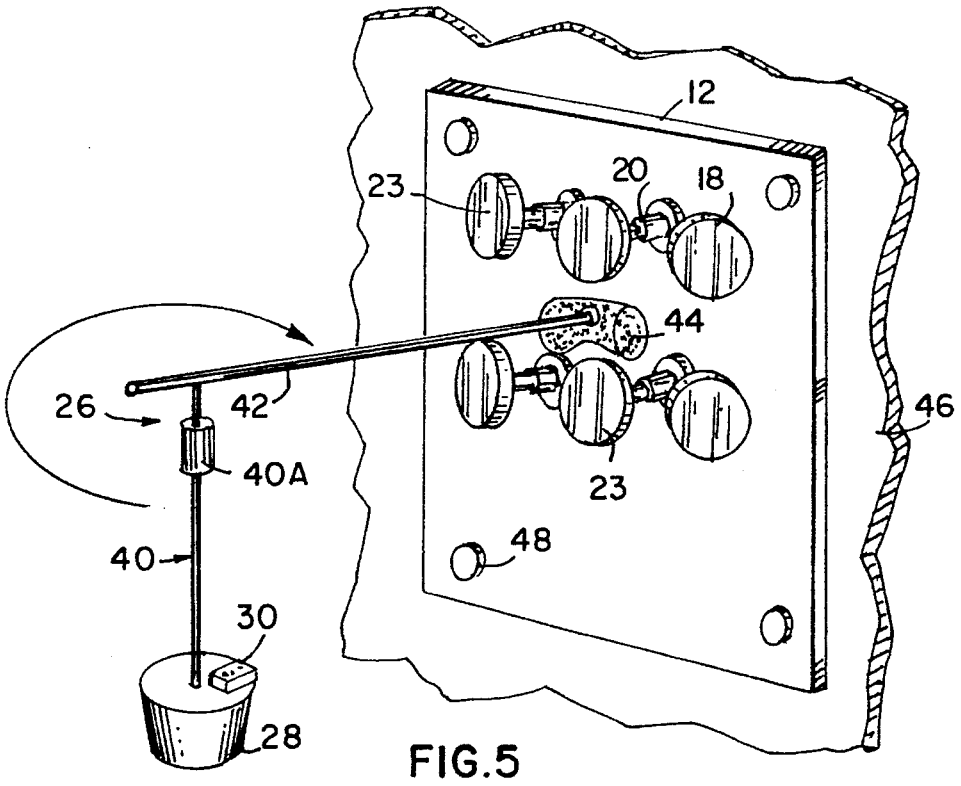
FIG. 5 is a fragmentary view of the six pad devices attached to a wall.

FIG. 5 shows the flat board 12 as having a shorter bottom and is attachable to a wall 46 by wing nuts 48.

Figure 6:
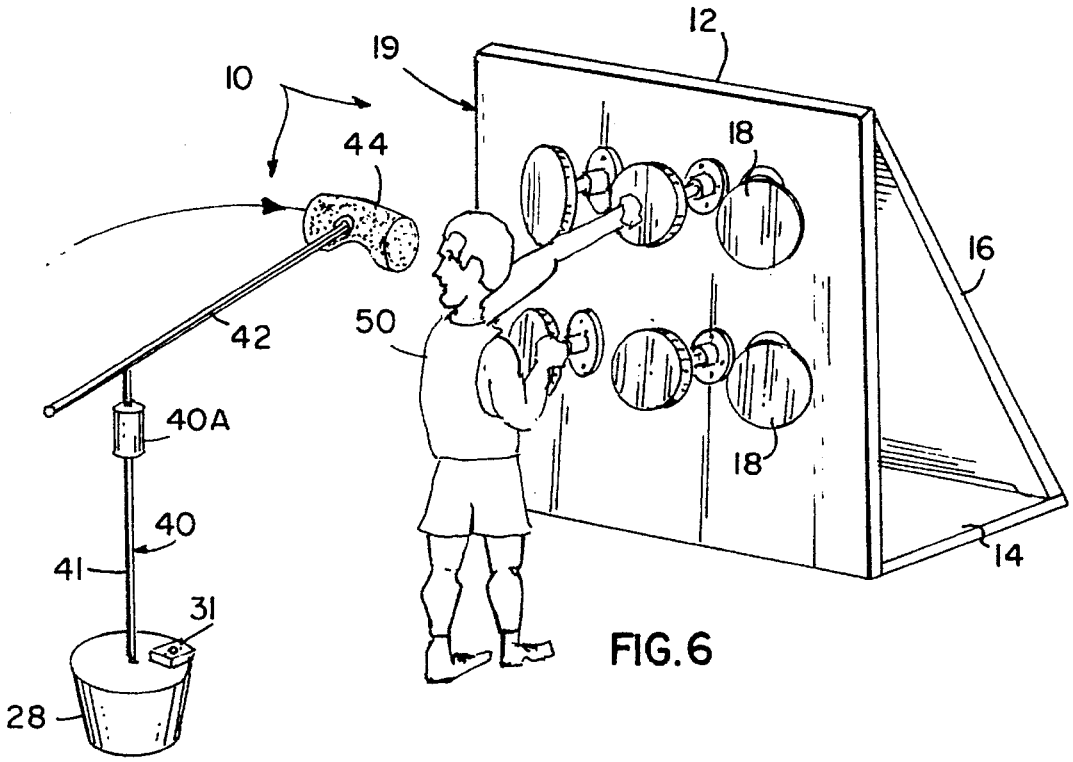
FIGS. 6 and 7 illustrate an example of the operation of the punching device by an individual.
Figure 7:
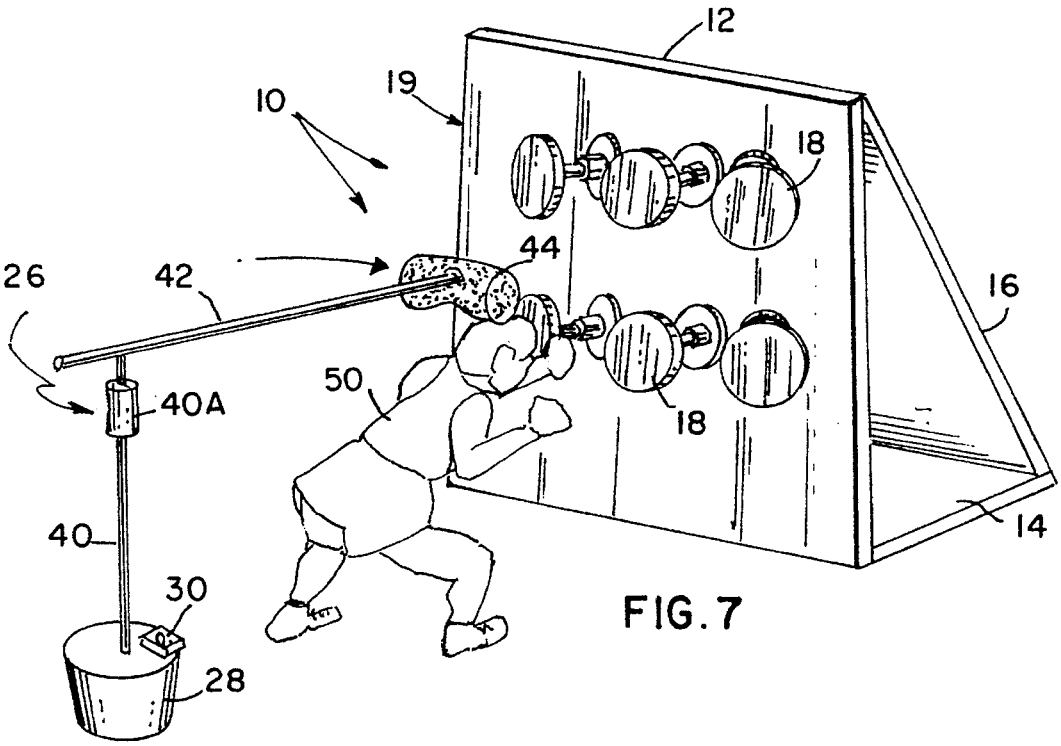

FIGS. 6 and 7 illustrate one example of how a person 50 uses the punching device of the present invention. As illustrated in FIG. 6, the person 50 punches the pad devices 18 while the arm device 42 of the motorized arm 26 rotates around toward the area 19 between the upper pad devices 18 and the lower pad device 18. As illustrated in FIG. 7, the person 50 bends down to avoid the boxing glove 44 as it rotates. It is also to be understood that the boxing glove 44 can be punched and blocked by the person 50 instead of bending down. This would stop the arm device 42 from rotating until the person 50 stops punching it and lets it continue rotating. The equipment of the motorized arm device 26 is arranged so that a boxing glove 44 can be rotated at a variety of speeds, including a random setting, and can be temporarily stopped when the person contacts it.

Figure 8:
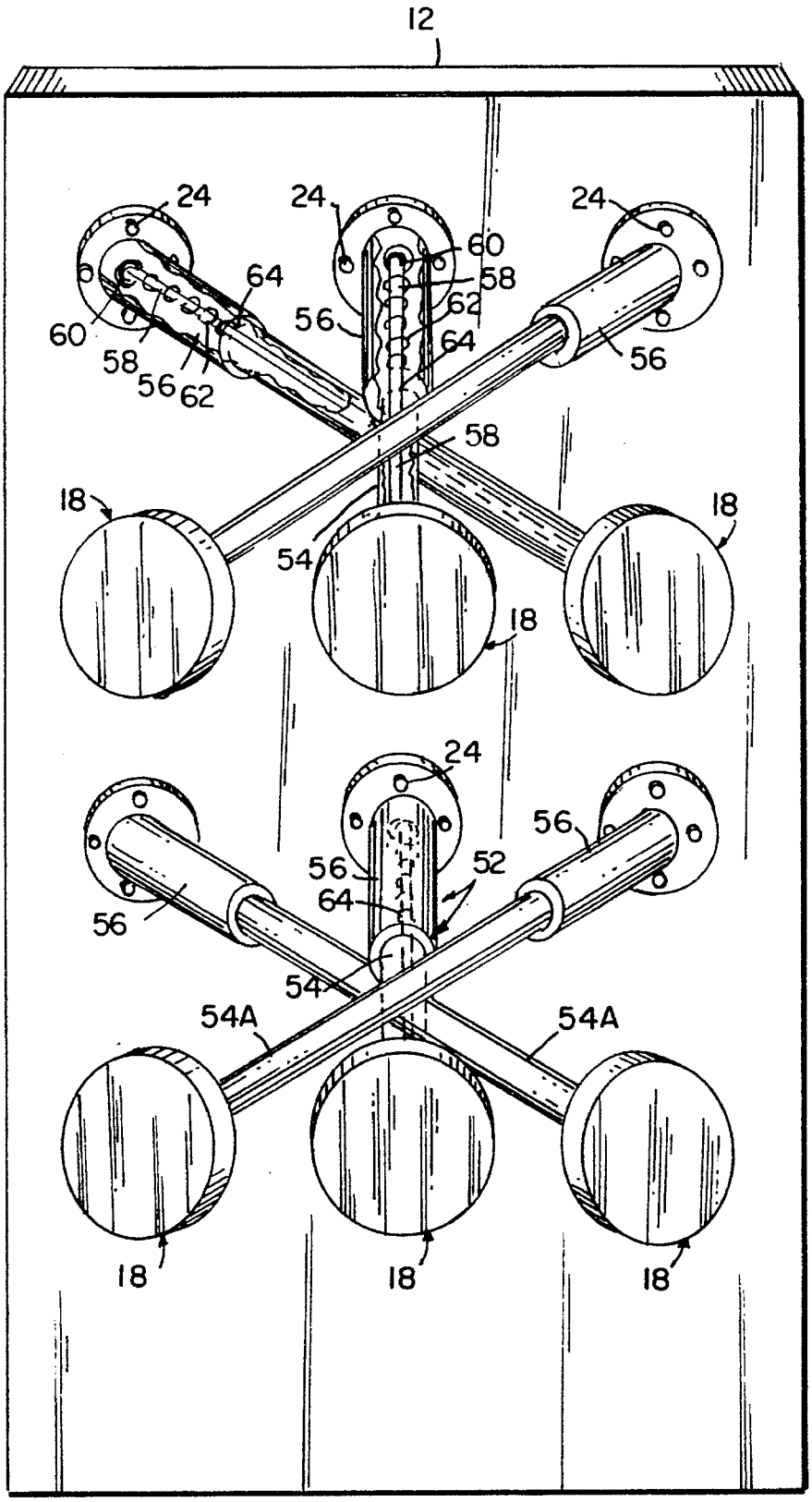
FIG. 8 is an upper view of an alternate embodiment of the attaching devices of the pad devices.

Referring now to FIG. 8, there is another embodiment of the invention showing how the round pad devices 18 are attached to the flat board 12. In this embodiment the middle attaching device 52 consists of two cover devices. The cover device 54 is attached to the center pad device 18 and is inserted partly within the second cover device 56 which is attached to the nut member 24. Within the cover devices 56 and 54 is a cable 58 which is attached to the nut member 24 and the center pad device 18 by the eyelets 60. Positioned about the cable 58 is a heavy resistance spring material 62 which is attached to the inner section of the nut member 24 and the under section 64 of the cover device 54. In this middle embodiment when the pad device 18 is punched cover device 54 extends back within the second cover device 56 and extends back out when the punching hand is removed. The side pad devices 18 are attached by longer cover devices 54 so that they can extend to the left and right sides of the center device 54. As indicated the longer cover devices 54 also indicated as 54A are sufficiently long so that one is attached to the left side of the nut member 24 and extends to the right side of the center pad device 18 and the other is attached to the right side of the nut member 24 and extends to the left side of the center pad device 18. In this method the left and right pad devices 18 can be punched in different areas. As indicated, one long cover device 54A is above the center cover device 54 and the other long cover device 54A is below the center cover device 54.

Figure 9:
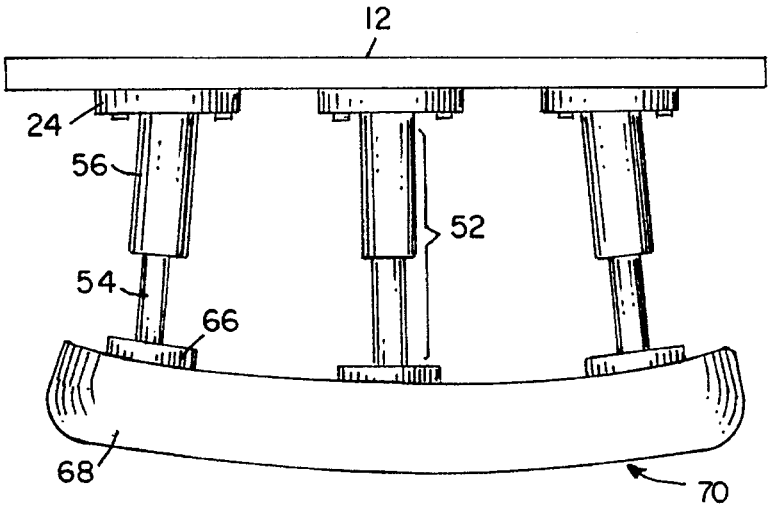
FIGS. 9 and 10 illustrate an alternate embodiment of the punching device of the present invention.
Figure 10:
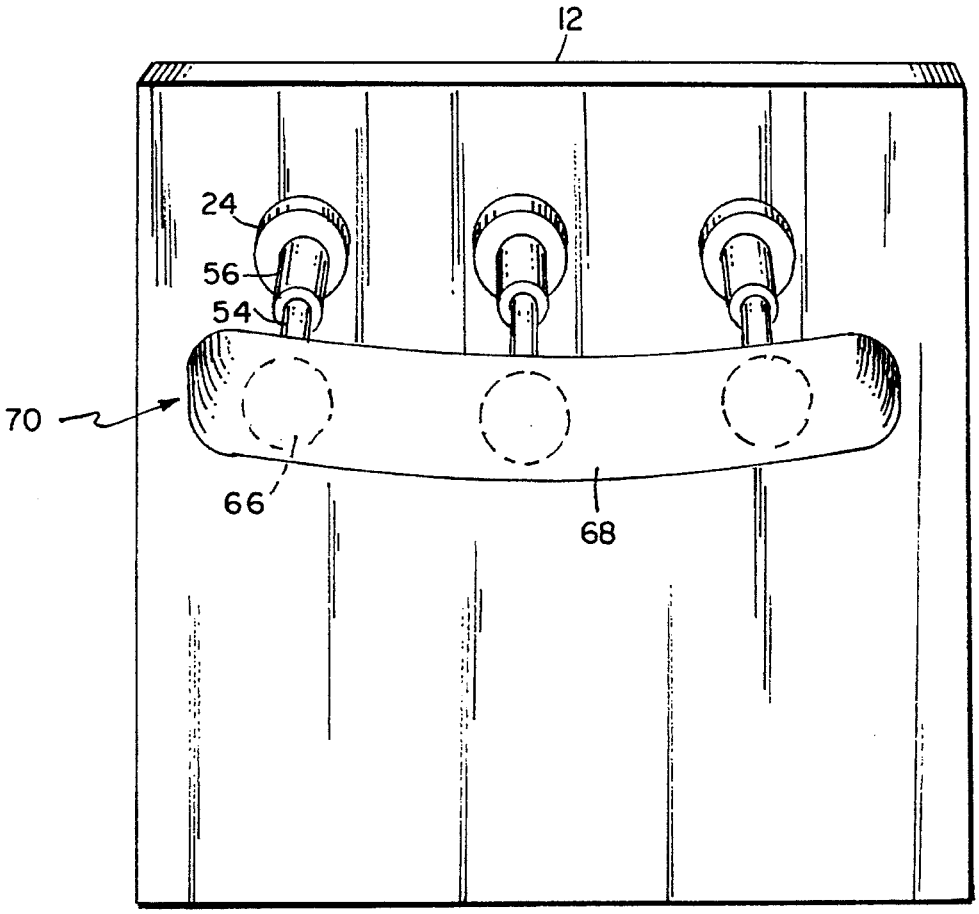

Referring now to FIGS. 9 and 10, there is illustrated an alternate embodiment of the punching device 70 of the present invention. In this embodiment each of the forward cover devices 54 are provided with a forward attaching device 66 which is attachable to the single larger pad device 68. In this embodiment the person 50, for example, is able to punch the pad device 68 at any front position. It is also to be understood that two punching devices 70 can be attached to the flat board 12. Additionally the motorized arm device 26 would also be included.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. A punching device for punching practice to sharpen skills of a user in punching while avoiding a component of the punching device, said punching device comprising:

an upstanding flat board;

six pad devices attached to an upper front portion of the flat board in two horizontal groups of three pad devices, where one group is horizontally attached at a distance below the other group;

wherein each pad device includes a pad portion, an inner cover device and an outer cover device that is attached to the flat board;

wherein the pad portion is attached to the inner cover device which is attached within the outer cover device;

wherein the inner cover device of a middle pad device of each grouping is arranged so as to be substantially perpendicular to the flat board; and wherein the inner cover device of each side pad devices of each grouping is arranged at an angle to the flat board and is of a predetermined length so the inner cover device of each side pad device extends from one side to the other side of the middle pad device.

2. A punching device for punching practice to sharpen skills of a user in punching while avoiding a component of the punching device, said punching device comprising:

an upstanding flat board;

six pad devices attached to an upper front portion of the flat board in two horizontal groups of three pad devices, where one group is horizontally attached at a distance below the other group;

wherein each pad device includes a pad portion, an inner cover device and an outer cover device that is attached to the flat board;

wherein the pad portion is attached to the inner cover device which is attached within the outer cover device;

wherein the inner cover device of a middle pad device of each grouping is arranged so as to be substantially perpendicular to the flat board; and wherein the inner cover devices of the side pad devices of each grouping are arranged at an angle other than 90 degrees to the flat board.

3. The punching device of claim 2, wherein the pads portions of the pad side devices of each grouping are each attached to a longer inner cover device, wherein the longer cover device of one side pad device extends right about the inner cover device of the middle pad device and wherein the longer inner cover device of the other side pad device extends left below the inner cover device of the middle pad device.

* * * * *